US005162029A

United States Patent [19]

Gerard

[11] Patent Number: 5,162,029

[45] Date of Patent: Nov. 10, 1992

[54] APPARATUS FOR TEACHING DOWNHILL SKIING ON A SIMULATED SKI SLOPE

[75] Inventor: Philip G. Gerard, Studio City, Calif.

[73] Assignee: G. David Schine, Los Angeles, Calif.

[21] Appl. No.: 828,504

[22] Filed: Jan. 31, 1992

[51] Int. Cl.[5] ..... A63B 69/18

[52] U.S. Cl. ..... 482/71; 482/54; 198/861.1

[58] Field of Search ..... 482/54, 71; 198/861.1, 198/861.5; 434/253

[56] References Cited

U.S. PATENT DOCUMENTS

| | | | |
|---|---|---|---|
| 3,093,232 | 6/1963 | Kornylak | 198/861.5 |
| 3,408,067 | 10/1968 | Armstrong | 434/253 |
| 4,428,064 | 1/1984 | Wiik | 482/71 |
| 5,000,440 | 3/1991 | Lynch | 482/54 |
| 5,104,119 | 4/1992 | Lynch | 482/54 |

*Primary Examiner*—Richard J. Apley
*Assistant Examiner*—Lynne A. Reichard
*Attorney, Agent, or Firm*—Antonio M. Fernandez

[57] ABSTRACT

A ski-deck adapted to be easily knocked down for storage or transport is provided by having telescoping side frames that secure rollers on bearings for a looped carpet over a ski deck and adjustable fitting on vertical support rails secured to horizontal support rails in order to adjust the height and slope of the ski deck. Horizontal safety rails are secured to vertical support rails for a waist belt and ski-grips with a safety switch that will stop the motor drive for the looped carpet. A motor speed control potentiometer is provided on top of a vertical support rail for the ski student's use in adjusting the simulated downhill skiing speed desired.

7 Claims, 4 Drawing Sheets

APPARATUS FOR TEACHING DOWNHILL SKIING ON A SIMULATED SKI SLOPE

BACKGROUND OF THE INVENTION

This invention relates to a simulated ski slope of the type disclosed by R. L. Hall in U.S. Pat. No. 3,164,247 consisting of an inclined deck and a continuous wide belt of material having a low coefficient of friction. The belt is made continuous by forming a closed loop around cylinders (hereinafter referred to as rollers) at the top and bottom of the inclined deck mounted on rotary axles. One of the rollers is driven by an electric motor to move the belt in an upward direction over the inclined deck.

The Hall ski deck was sixteen feet wide and thirty feet long, so that the loop belt weighed approximately 1500 pounds. Consequently, it was very difficult to set up the apparatus and install the belt. Moreover, it required a very large amount of power to move the belt over the inclined deck at speeds of five to twenty miles per hour in order to give the person skiing on the inclined deck the sensation of moving down the slope as the belt moves up over the inclined deck.

It has been discovered that a ski deck of the Hall type need not be so large in order to give instructions to a beginning skier or to give advanced instructions to an experienced skier, such as how to traverse and turn over moguls, which are bumps or ridges of closely packed snow built up on a curve where skiers turn as they cut back and forth on the slope of a mountain. Consequently, an object of this invention is to provide a ski deck of the Hall type that can fit in a normal room with an eight foot ceiling and can be more readily set up for use and knocked down for storage or moving to a different location. Another object is to facilitate simulating moguls on the looped belt, and to secure the moguls in such a manner as to permit the moguls to be placed anywhere on the looped belt and to make the turn at the rollers for another pass under and around the lower roller, up the inclined deck and over the upper roller.

SUMMARY OF THE INVENTION

In accordance with the present invention, a simulated ski slope of the type having an inclined deck and a continuous belt of material having a low coefficient of friction formed in a closed loop around rollers at the top and bottom of the slope is assembled in two parts. One part constitutes the support frame that sits on the floor comprising two parallel longitudinal support rails, a pair of transverse support rails and four vertical support rails, one pair of vertical rails secured to each longitudinal support rail and a pair of transverse support rails. A ski-deck assembly placed between the two longitudinal support rails and the vertical support rails paired with the pair of transverse rails on each longitudinal support rail is then raised, such as by hydraulic floor jacks, to the height and slope desired.

The ski-deck assembly is comprised of telescoping side frames, one for each side, with bearings at each end for the two rollers. A ski deck, such as plywood, is secured over the side frames, but first the ski-deck belt loop is slipped over the rollers with their axles secured at only one end in bearings affixed to the side frame at that end. The other side frame is then placed over the other ends of the roller axes and secured to the vertical support rails. Thereafter, the telescoping side frames are extended until the belt is taut. Once that is done, the assembly may be adjusted in height and slope.

Upper side rails are secured to the paired vertical support rails on each side of the assembly, and two adjustable transverse rails are optionally secured to the vertical support rails over the ski deck. One transverse rail is provided with a safety belt secured to a sliding tube slipped over the rail behind the skier, and the other rail in front of the skier is provided with ski-pole grips secured to sliding tube means which may be two separate and independent tubes (which may be spaced apart a specified distance by an optional tube slipped over the transverse rail between the two separate and independent tubes) or one single tube with two ski-pole grips one spaced apart the aforesaid specified distance. At least one ski-pole grip of each optional pair has a safety switch mounted on top to be depressed by the skiers thumb. Should the skier start to fall, the skier will instinctively move the thumb toward the index finger, then operates to turn off the motor drive to the roller that drives the ski-deck belt. The front rail with sliding ski-pole grips may be removed once the student has gained sufficient confidence, at which time conventional-type ski poles are used that have been modified to have the safety switch mounted on top of one grip. The other transverse rail equipped with a safety belt secured to a sliding tube is never removed for the protection of the student.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
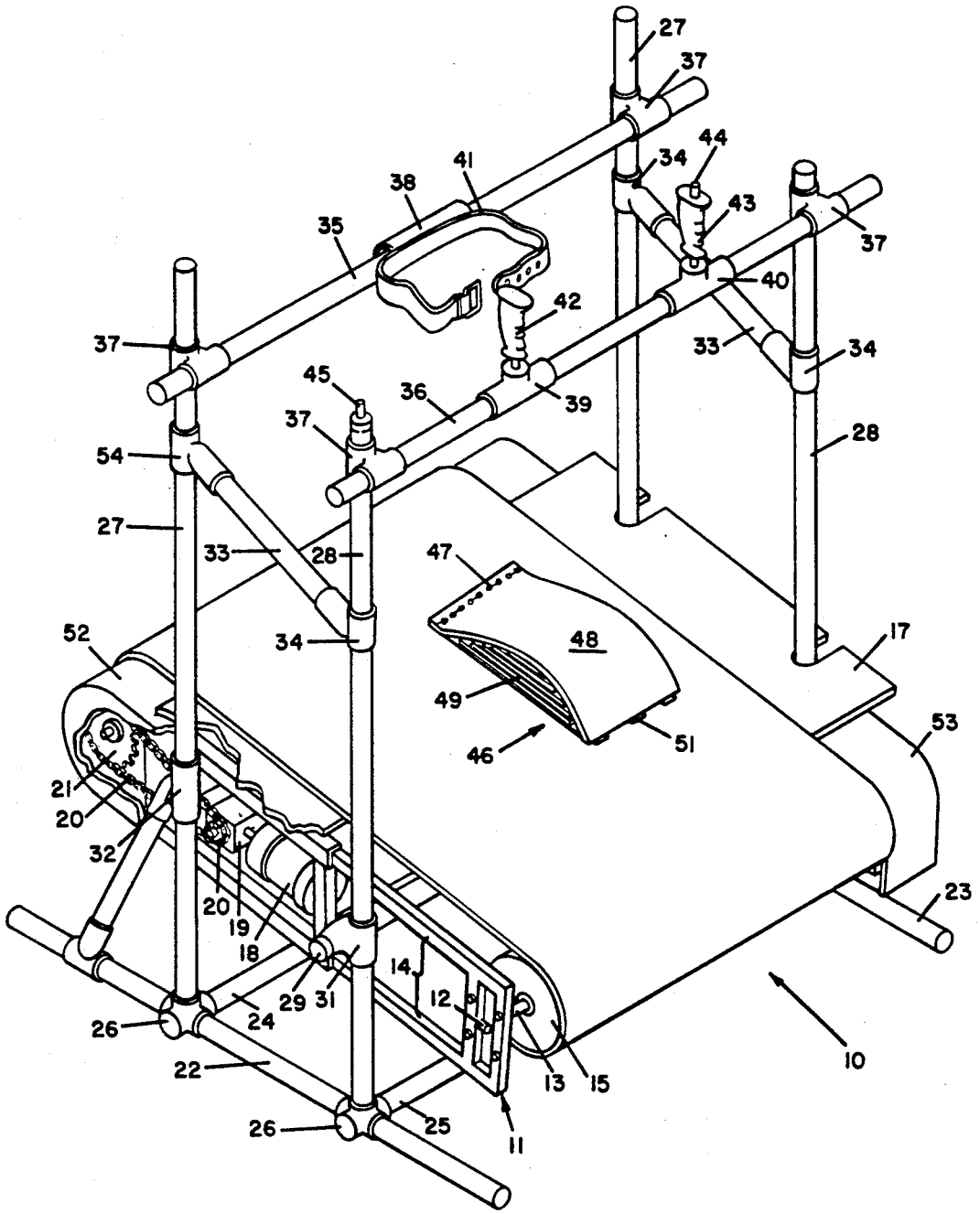
FIG. 1 is an isometric view of a ski deck with telescoping side frames in accordance with the present invention, including an optional mogul.
Figure 2A:
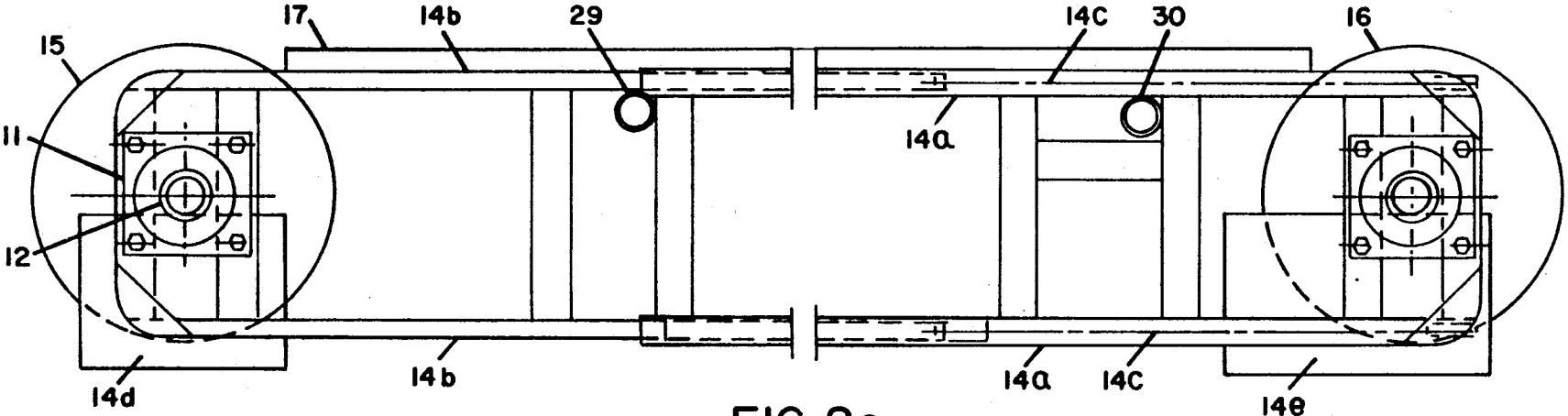
FIG. 2*a* is a side view of a telescoping frame on the far side of the ski deck shown in FIG. 1, which is a mirror image of the frame shown in the near side, except that only the frame on the near side supports an electric motor and gear box for chain driving a roller at the top of the ski deck to move an endless loop belt up over the ski deck.

Referring to FIGS. 1 and 2, objects of the invention are achieved by providing at each side of an inclined ski deck 10 a rectangular frame 11 with a flanged bearing at each end for roller axles 13, such as a roller bearing equipped with a rectangular flange for affixing the bearing to the frame for each axle. These side frames are positioned in a vertical plane on each side of the ski deck 10 and inclined for the desired slope of the ski deck. Each frame is constructed with telescoping box beams 14*a* and 14*b*, as shown in FIG. 2*a* for the far side in FIG. 1, to form the inclined support of the ski deck so that after the looped belt has been slipped over rollers 15 and 16, the telescoping side frames 11 may be extended until the belt loop is taut over a deck 17 supported by the telescoping side frames.

Figure 2B:
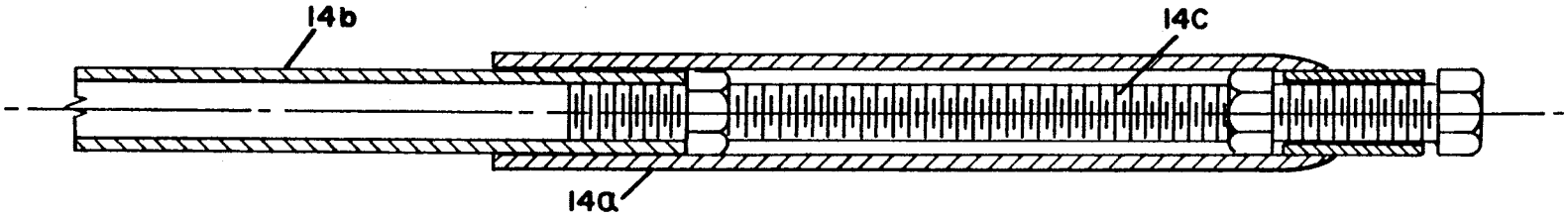
FIG. 2*b* illustrates the arrangement of a lead screw for adjusting the length of the telescoping side frame shown in FIG. 2*a* in order to adjust the tautness of the belt on one side independent of the other side.

FIG. 2*b* illustrates a lead screw 14*c* passing through each outer box beam 14*a* to the end of the inner box beam 14*b*, where it is secured to the inner box beam by means that will permit the lead screw to rotate in threads of a square nut affixed to the end of the inner box beam 14*b*. The other end of the lead screw is secured to the outer box beam by means that will permit the lead screw to rotate but not move axially. These lead screws may be independently adjusted in the side frames 11 on both sides of the ski deck to cause the looped belt to track on the rollers. Otherwise the looped belt would tend to walk off one end or the other of the rollers. To assist in tracking, each frame is provided with plates 14*d* and 14*c* bolted against the roller flanges. These plates extend below rollers so that they function as limit guides for the looped belt. Should the looped belt stretch after some period of use of the ski deck, the telescoping box beams may be readjusted until the looped belt again tracks without rubbing against the plates 14*d* and 14*e*.

Affixed to one telescoping frame is a variable speed electric motor 18 and a gear box !9 with a small sprocket wheel 20 driven by the shaft of the motor to turn a large chain-driven sprocket 21. The axle of the roller 16 at the upper end of the ski deck is adapted to the large chain-driven sprocket 21 after the axle has been placed in its flange bearing secured to the side frame 11. Although the bearing at both ends of each roller are preferably roller bearings, other conventional bearings may be used, such as ball bearings:

Once the assembly comprised of rollers, looped belt and telescoping side frames has been completed over a base resting on the floor consisting of two parallel side support rails 22 and 23 connected by two transverse support rails 24 and 25 using suitable cross-rail fittings 26, two parallel vertical support rails 27 and 28 are fastened to the base at the cross-rail fittings on each side of the ski deck. Following that, two horizontal support rails 29 and 30 are passed through the two side frames and affixed at each end to adjustable fittings 31 and 32 that permit the two ends of each horizontal support rail to be raised on the vertical support rails 27 and 28, thus independently raising each end of the assembly of rollers, belt loop and telescoping side frames a desired height to incline the ski deck for a desired slope. A set screw or pin in each adjustable fitting 31 and 32 that slide on vertical support rails 27 and 28 will then secure the ski deck in place.

An upper side rail 33 is placed between the two vertical support rails 27 and 28 on each side of the ski deck 10 using adjustable fittings 34 to stabilize the vertical support rails 27 and 28 that extend substantially above the inclined ski deck. The adjustable fittings 34 for these upper side rails 33 are secured with set screws or pins at positions above the inclined ski deck 10 at all four adjustable fittings 34 below the waist of a skier. Two transverse rails 35 and 36 are then secured at each end to the two vertical support rails 27 and 28 using adjustable fittings 37, a rear transverse rail 35 between the two vertical support rails 27 and a front transverse rail 36 between the two vertical support rails 28.

Figure 3B:
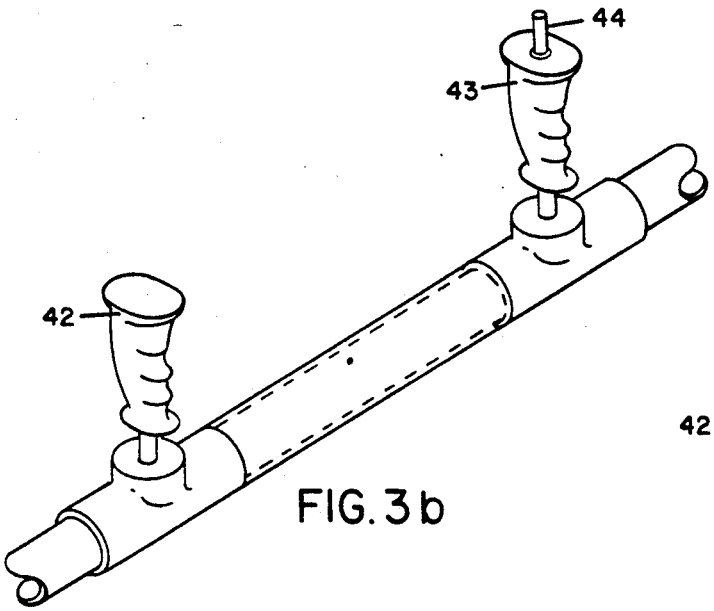
FIGS. 3*a, b* and *c* illustrate three arrangements for providing ski-pole grips, one grip being equipped with a safety push-button thumb switch that stops the electric motor of the ski deck when released.
Figure 3A:
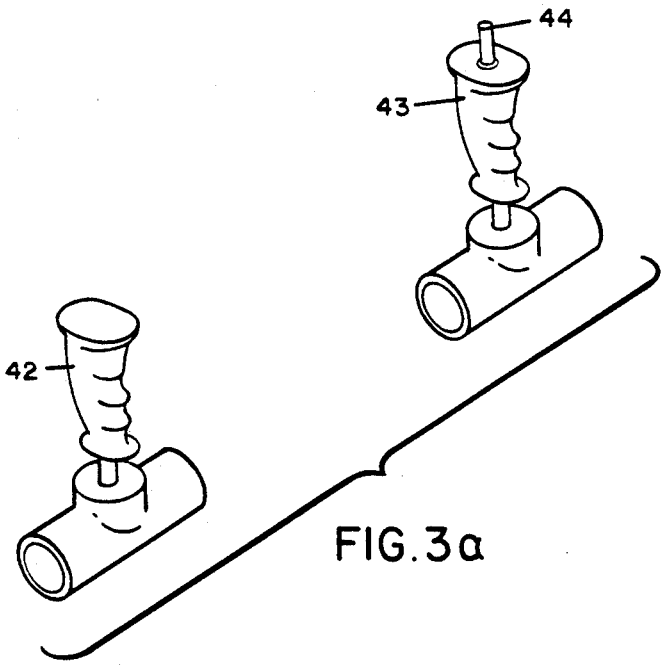
Figure 3C:
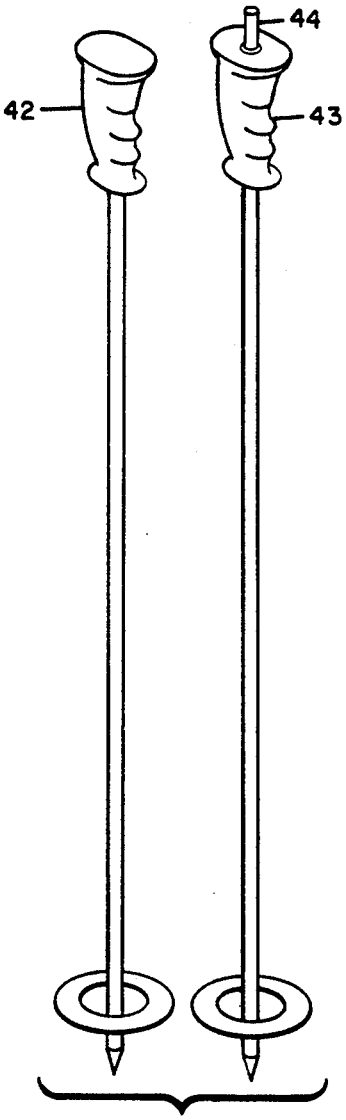
Figure 4A:
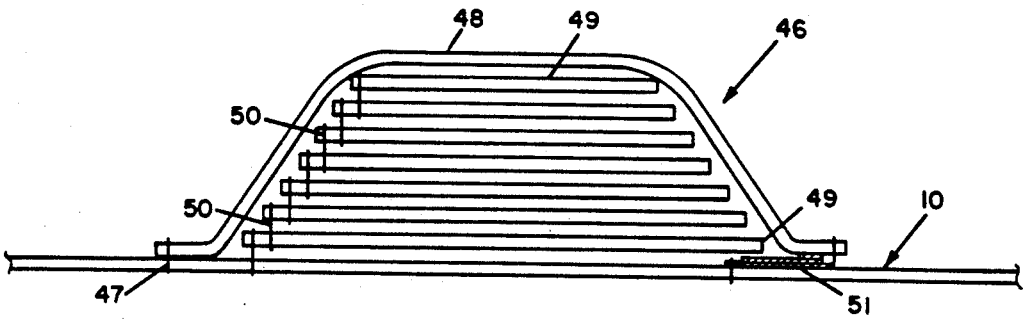
FIGS. 4*a* and 4*b* are side elevation and plan views of a mogul showing how it is constructed, and how it may be built up with layers of carpeting material to any desired height.

A slide tube 38 is fitted over the rear transverse rail 35 and two slide tubes 39 and 40 shown in FIG. 4*a* are fitted over the front transverse rail 36. A body-support belt 41 is secured to the slide tube 38 over the rear transverse rail 35 and ski-pole grips 42 and 43 are secured to the slide tubes 39 and 40 over the front transverse rail 36. These ski-pole grips simulate ski poles in that as the skier simulates planting ski poles, the slide tubes 39 and 40 to which attached will stop sliding on the rail 36. The skier may then rely upon them for support as he changes direction just as though he planted ski poles on a snow ski slope. Rubber cemented to the inside of these slide tubes 39 and 40 on the upper surfaces thereof may be added to increase friction on the rail 36 and thus enhance the ski-pole planting effect. Instead of just two separate and independent slide tubes with ski-pole grips as shown in FIG. 3*a*, a spacing tube of appropriate length may be used between the two slide tubes and ski-pole grips as shown in FIG. 3*b*. Eventually a student will acquire enough confidence that the front rail 36 may be removed. Regular ski poles are then used as shown in FIG. 3*c* equipped with a safety thumb push-button switch described below.

Initially, the slide tubes with ski grips are used on the horizontal bar with a spacing between them as shown in FIG. 3*c* so that the student learns to keep the ski poles out in front, one on each side. Then the spacing tube may be removed leaving the independent slide tubes shown in FIG. 3*a*, and finally the separate and independent slide tubes with the ski-pole grips are removed, as well as the front horizontal bar. The student then uses more conventional ski poles as shown in FIG. 3*c*, but modified to have a push-button safety switch in one grip to stop the ski-deck belt if the thumb is ever removed from the switch.

One of the ski-pole grips shown in FIG. 3*a, b* or *c* is provided with a push-button safety switch 44 protruding out of the top. A skier using this system for instruction and training is instructed to press the push-button safety switch 44 with the thumb to start the drive motor. That closes a switch for a transmitter in the grip to send a signal to the motor 18 to close an electromagnetic switch at the motor against the force of a spring that normally holds the motor switch open. If the skier starts to fall, the fingers on the ski-pole grip will tighten, and the natural tendency of that tightening is to move the thumb down to the index finger for a better and stronger grip, thus instinctively releasing the safety switch 44 which will terminate transmission of a signal. The consequence of that is to terminate the electromagnetic force on the motor switch so that the spring loaded motor switch opens. This stops the motor drive, but the looped belt does not stop abruptly because of the momentum of the rollers 15 and 16 and the looped belt itself. Instead, the rollers and looped belt stop smoothly, allowing the skier to regain his balance, so that if the skier again depresses the push-button safety switch 44, the looped belt drive over the ski deck 17 will resume and smoothly pick up speed. The signal transmitted to the motor from the safety switch is transmitted as radio waves from a transmitter in the grip to a receiver at the motor in a manner analogous to opening a garage door from a hand-held transmitter.

A speed control potentiometer 45 is mounted on top of a front vertical support 28 on one side. With experience, a student may want to increase the speed of the belt from about 5 MPH toward 10 MPH or higher. All that would be required is for the skier to ski over to that vertical support and turn the potentiometer 45 up. That potentiometer may be hard wired to the speed control circuit of the motor.

Figure 4B:
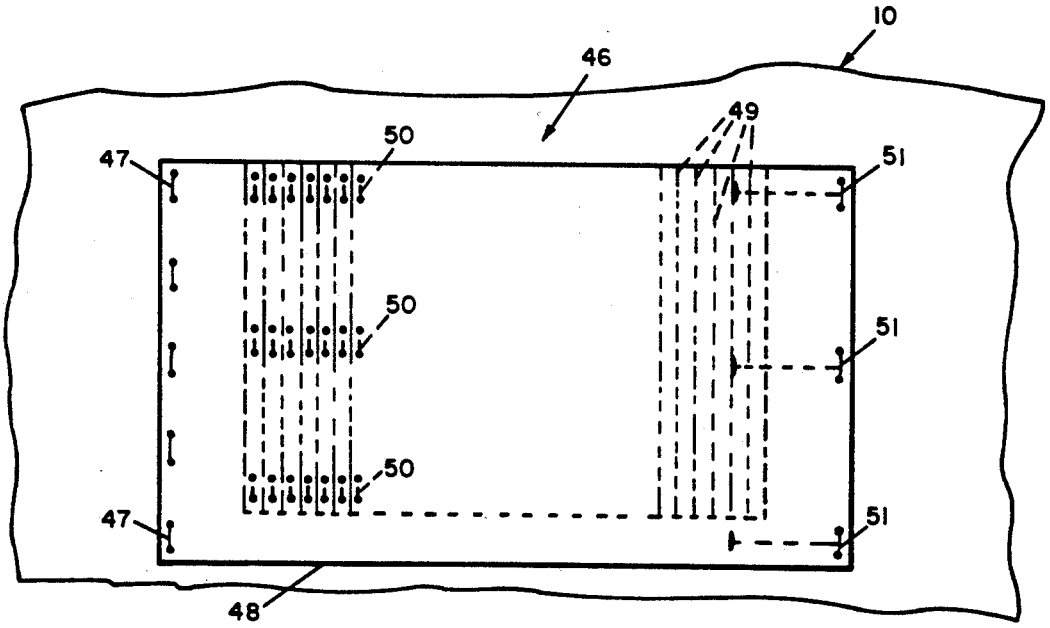

The mogul 46 shown in FIGS. 4*a* and 4*b* may be placed anywhere on the looped belt using nylon ties 47 on the leading edge of a section of carpet 48, and the height of the mogul is built up by piling under that section of carpet 48 as many sections of carpet 49 as required for the height of the mogul desired, each one fastened to the next one at its leading edge with nylon ties 50 and each one added being of shorter length as shown in FIG. 4*a* and FIG. 4*b*. In FIG. 4*b*, the top section of carpet 48 is illustrated as though it were made of transparent material so that the other sections of carpet and their nylon ties may be seen. In actuality, that would not be the case. Instead, the same carpet material is used as for all layers of carpet.

Once the mogul 46 on the looped belt reaches the rear roller 16, the outer section of carpet 48 is allowed to fall partially away together with all the inner sections 49 of carpet. Bungee cords 51 at the trailing edge of the section of carpet 48 prevent all the sections of carpet from falling completely away from the looped belt as the mogul travels up over the roller 16 and under the ski deck to reappear from under the front roller 15.

Although particular embodiments of the invention have been described and illustrated herein, it is recognized that modifications and equivalents may readily occur to those skilled in the art. For example, although it is contemplated that the height of the inclined ski-deck assembly will be raised at each corner by conventional hydraulic jacks under adjustable fittings 31 and 32 on the vertical support rails and then affixing the adjustable fitting on the rails in order to set the desired slope for the ski deck, it would be quite acceptable to provide four hydraulic jacks, one for each adjustable fitting and to then leave the floor jacks in place. That then obviates the need for securing the adjustable fittings on the vertical rails by set screws or pins. It is also contemplated that covers be provided over the side frames. Such a cover broken away is indicated at 52 on the near side of the ski-deck assembly shown in FIG. 1, and a full cover is indicated at 53 on the far side.

I claim:

1. A simulated ski slope having an inclined ski deck and a continuous wide belt of material having a low coefficient of friction formed in a closed loop around rollers at the top and bottom of the inclined deck mounted on rotary axles that turn in bearings supported by a frame, an assembly comprised of two rectangular side frames, each side frame having bearings at each end for said axles of said rollers, each side frame comprising a pair of telescoping box beams comprising the longer sides thereof, and means for securing said telescoping box beams in a position that holds said belt in a taut loop around said rollers having axles in said bearings, and a support frame for said ski deck assembly comprising said side frames held in vertical planes with said rollers held in horizontal planes by said bearings supported by said side frames, said support frame further comprising a floor frame having two parallel longitudinal support rails and two transverse support rails, all in a horizontal plane; four vertical support rails, two on each side of said ski deck assembly secured to said two parallel longitudinal support rails; and two horizontal support rails, each passing between said pair of telescoping box beams of both side frames of said assembly, and each held at each end by a fitting on each of said vertical support rails, said fitting being positionable along the length of said vertical support rails in order to adjust the slope of said ski deck.

2. A simulated ski slope comprised of an assembly supported as defined in claim 1 by said four vertical support rails, further comprising a transverse rail extending between two of said vertical support rails opposite each other with respect to said ski deck, a slide tube fitted over said transverse rail and two ski-pole grips, one grip secured to each end of said slide tube.

3. A simulated ski slope comprised of an assembly supported as defined in claim 2 by said four vertical support rails, two slide tubes fitted over said transverse rail, and two ski-pole grips secured to each slide tube.

4. A simulated ski slope comprised of an assembly supported as defined in claim 1 including an electric motor means for driving one of said rollers to move said belt over said ski deck, further comprising a transverse rail extending between two of said vertical support rails opposite each other with respect to said ski deck, slide tube means fitted over said transverse rail, two ski-pole grips secured to said slide tube means, and at least one of said grips having a push-button safety switch protruding upwardly from said one of said grips, whereby said switch may be depressed by a skier's thumb to cause said electric motor means to drive said belt and to cause said electric motor means to stop when said skier releases said push-button safety switch.

5. A simulated ski slope comprised of an assembly supported as defined in claim 1 including an electric motor means for driving one of said rollers to move said belt over said ski deck, further comprising ski poles, each ski pole having a grip at the upper end thereof, and at least one of said grips having a push-button safety switch protruding upwardly from said one of said grips, whereby said switch may be depressed by a skier's thumb to cause said electric motor means to drive said belt and to cause said electric motor means to stop when said skier releases said push-button safety switch.

6. A simulated ski slope as defined in claim 1 including an electric motor means for driving one of said rollers to move said belt over said ski deck further comprising a speed-control potentiometer for said electric motor means, said speed-control potentiometer mounted at the top of one of said four vertical support rails.

7. A simulated ski slope as defined in claim 1 including at least one mogul comprised of a first section of carpet secured to said belt by non-elastic ties on the leading edge of said one section of carpet, and a plurality of sections of carpet under said one section, said plurality of sections of carpet being stacked and progressively smaller in the order stacked, each secured by non-elastic ties on the leading edge thereof to a preceding section of carpet, except the first which is secured by non-elastic ties on the leading edge thereof directly to said belt, said first section of carpet being large enough to overlay said stacked plurality of sections of carpet, and elastic ties securing the trailing edge of said first section of carpet to said belt.

* * * * *